US005816937A

United States Patent [19]

Shimosaka et al.

[11] Patent Number: 5,816,937

[45] Date of Patent: Oct. 6, 1998

[54] GOLF BALL HAVING A MULTILAYER COVER

[75] Inventors: Hirotaka Shimosaka; Keisuke Ihara; Yutaka Masutani; Michio Inoue; Atuki Kasasima, all of Saitama, Japan

[73] Assignee: Bridgestone Sports Co., Ltd., Tokyo, Japan

[21] Appl. No.: 780,825

[22] Filed: Jan. 10, 1997

[30] Foreign Application Priority Data

Jan. 12, 1996 [JP] Japan ..... 8-22110

[51] Int. Cl.[6] ..... A63B 37/12; A63B 37/06

[52] U.S. Cl. ..... 473/354; 473/364; 473/365; 473/373; 473/376

[58] Field of Search ..... 473/373, 374, 473/376, 354, 364, 365

[56] References Cited

U.S. PATENT DOCUMENTS

| | | | |
|---|---|---|---|
| 705,764 | 7/1902 | Kempshall | 473/376 X |
| 2,939,710 | 6/1960 | Dosmann et al. | 473/737 X |
| 4,431,193 | 2/1984 | Nesbitt | 473/374 |
| 4,570,937 | 2/1986 | Yamada | 473/372 X |
| 5,273,286 | 12/1993 | Sun | 473/377 X |
| 5,439,227 | 8/1995 | Egashira et al. | 473/373 |

*Primary Examiner*—Geroge J. Marlo
*Attorney, Agent, or Firm*—Sughrue, Mion, Zinn, Macpeak & Seas, PLLC

[57] ABSTRACT

A golf ball comprising; a core and a multi-layered cover having an innermost layer enclosing the core, at least one intermediate layer enclosing the innermost layer, and an outermost layer enclosing the at least one intermediate layer. The innermost layer is composed of an ionomer resin, polyester elastomer, polyamide elastomer or polyurethane elastomer. The at least one intermediate layer is composed of an ionomer resin. The outermost layer is composed of an ionomer resin, ethylene-vinyl acetate copolymer, polyurethane or polyethylene or a mixture thereof, and the at least one intermediate layer includes at least one layer which is harder than the innermost layer and the outermost layer.

20 Claims, 2 Drawing Sheets

GOLF BALL HAVING A MULTILAYER COVER

BACKGROUND OF THE INVENTION

1. Field of the Invention

This invention relates to a golf ball comprising a cover of a multilayer structure having at least three layers.

2. Prior Art

Ionomer resin base materials are often used as the cover stock for wound golf balls as well as solid golf balls. The cover stock is molded around the core by injection molding and compression molding techniques. There are proposed golf balls having a wound core or solid core enclosed with such a cover.

These golf balls, however, are not fully optimized with respect to feeling, initial velocity, and spin rate. For example, balls with good spin properties do not offer a satisfactory initial velocity upon driver shots with a driver. Inversely, balls offering a satisfactory initial velocity have a hard feel and inferior spin properties and are sometimes difficult to control on approach shots with a sand wedge or rolling with a putter. There is not available a golf ball which satisfies all of the above-mentioned requirements.

Therefore, an object of the present invention is to provide a golf ball which has a pleasant soft feel, gains an increased initial velocity upon driver shots, is improved in spin upon sand wedge shots, and is easy to control upon approach shots.

SUMMARY OF THE INVENTION

In connection with a golf ball comprising a core and a cover of a multilayer structure having an innermost layer enclosing the core, at least one intermediate layer enclosing the innermost layer, and an outermost layer enclosing the intermediate layer, the inventors have found that if the intermediate layer includes at least one layer which is harder than the innermost and outermost layers, the ball is improved in feel, initial velocity, and spin.

The inventors have found that major factors governing the initial velocity of a golf ball are the head speed of a club and the restitution of the ball. Since the club head speed is associated with a player, but not with the ball itself, the initial velocity of the ball largely depends on the ball's restitution. The restitution, in turn, is correlated to the core and the cover of the ball. If core parameters are fixed, cover parameters including hardness, gage and material have significant influence on the initial velocity of the ball.

Based on this finding, the inventors continued study to find that better results are obtained when the cover innermost layer and the cover outermost layer are softer than the cover intermediate layer or the inside one of the cover intermediate layers closely enclosing the cover innermost layer, especially when the cover outermost layer has a Shore D hardness of less than 55 degrees, the cover innermost layer has a Shore D hardness of less than 55 degrees, and the cover intermediate layer or the inside one of the cover intermediate layers has a Shore D hardness of not less than 55 degrees. With this construction, the harder cover intermediate layer plays the role of gaining an initial velocity enough to increase the flight distance while the softer cover innermost and outermost layers provide for a better feeling. Additionally, the spin property is improved to such an extent that the ratio B/A may be at least 2.5/1 provided that the golf ball gains a spin rate A when shot with a driver at a head speed of 45 m/sec. and a spin rate B when shot with a sand wedge at a head speed of 19 m/sec. As compared with prior art golf balls with a single layer cover or a dual layer cover, the golf ball of the invention has better soft feel and is improved in initial velocity so as to travel a longer distance.

Accordingly, the present invention provides a golf ball comprising a core and a multi-layered cover having an innermost layer enclosing the core, one or more intermediate layers enclosing the innermost layer, and an outermost layer enclosing the one or more intermediate layers, wherein the one or more intermediate layers include at least one layer which is harder than the innermost layer and the outermost layer.

DETAILED DESCRIPTION OF THE INVENTION

Figure 1:
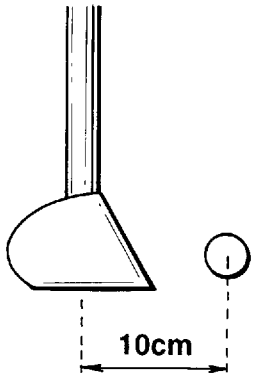
FIG. 1 illustrates how to hit a golf ball with a driver in a hitting test.

According to the invention, the golf ball includes a core 1 and a cover 2 of a multilayer structure having at least three layers wherein the hardness, gage, arrangement and material of the cover layers are controlled optimum.

The cover is of a multilayer structure having an innermost layer 3 enclosing the core, at least one intermediate layer 4 enclosing the innermost layer, and an outermost layer 5 enclosing the intermediate layer, all in a concentric fashion. In one preferred embodiment, the cover innermost layer has a Shore D hardness of less than 55 degrees, especially 40 to 51 degrees, the cover intermediate layer or the inside one of the cover intermediate layers has a Shore D hardness of not less than 55 degrees, especially 61 to 66 degrees, and the cover outermost layer has a Shore D hardness of less than 55 degrees, especially 34 to 52 degrees. Better results are obtained when these three conditions are met, that is, when the cover innermost layer and cover outermost layer are softer than the cover intermediate layer or the inside one of the cover intermediate layers. If the three cover layers have Shore D hardness values outside the above-mentioned optimum range, there would sometimes result harder feeling, lower initial velocity, and less satisfactory spin properties.

The cover intermediate layer 3 includes one or more layers. Preferably the cover intermediate layer consists of a single layer or two layers. Where the cover intermediate layer consists of more than one layer, the layer closely enclosing the cover innermost layer is designated the inside layer. It is understood that the inside layer of the cover intermediate layer is a third layer from the cover outermost layer if the cover is of four layer structure, and a fourth layer from the cover outermost layer if the cover is of five layer structure. With respect to the layer(s) of the cover intermediate layer other than the inside layer, a hard layer is selected if flight performance is to be sought and a soft layer is selected if feeling is more important.

The cover innermost layer 3 preferably has a gage or radial thickness of 1.0 to 2.0 mm, especially 1.4 to 1.8 mm. The material of which the cover innermost layer is made is not critical although ionomer resins, polyester elastomers, polyamide elastomers, and polyurethane elastomers are generally used. Preferred among these are ionomer resins which may be selected from well-known ones. For example, there are commercially available "Himilan" from Mitsui-duPont Polychemical K.K., "Surlyn" from E.I. duPont de Nemours Co., and "lotek" from Exxon. Ionomer resins may be used alone or in admixture of two or more. Titanium dioxide, barium sulfate, magnesium stearate, etc. may be added to the ionomer resin to adjust the specific gravity and hardness. There may also be added UV absorbers, antioxidants, and dispersing aids such as metal soaps if desired. The core may be enclosed with the cover innermost layer by any desired method. Usually, the core is wrapped with a pair of hemispherical preformed shells, followed by heat compression molding. Alternatively, a resin composition is injection molded over the core to form a cover innermost layer.

The cover intermediate layer preferably has a gage of 1.7 to 2.5 mm, especially 1.9 to 2.3 mm when it consists of a single layer (that is, the cover has a three layer structure). The cover intermediate layer is mainly formed of an ionomer resin similar to the above-mentioned ones. It may be formed by any desired one of conventional methods including injection molding and heat compression molding.

Where the cover intermediate layer 4 consists of two or more layers, the entirety of these constituent layers should preferably have a gage in the above-mentioned range. It is preferred that the inside one of the cover intermediate layers closely enclosing the cover innermost layer have the greatest gage among the cover intermediate layers, typically a gage of at least 1.7 mm.

Where the cover intermediate layer 4 consists of two or more layers, the inside one of the cover intermediate layers should preferably have the greatest hardness among the cover intermediate layers, that is a shore D hardness of 55 degrees or more, especially 61 to 66 degrees. The other one(s) of the cover intermediate layers are equal to or slightly lower than the innermost layer or the outermost layer, and preferably have a Shore D hardness of 30 to 54 degrees, more preferably 30 to 52 degrees.

The other one(s) of the cover intermediate layers may be made of ionomer resins, polyester elastomers, polyamide elastomers, and polyurethane elastomers.

The cover outermost layer 5 preferably has a gage of 0.02 to 1.1 mm, especially 0.1 to 0.5 mm. It may be formed of ionomer resins, ethylene-vinyl acetate (EVA) copolymers, polyurethane, and polyethylene alone or in admixture of two or more.

The cover outermost layer 5 may be formed by any desired one of conventional methods including injection molding and heat compression molding. Heat compression molding is preferred. In this case, for example, a laminate film including a resin layer to form the cover intermediate layer and another resin layer to form the cover outermost layer may be used. The laminate film is not limited to the two-layer film and a laminate film of three, four or more layers may be used if desired. The laminate film may be formed by any desired one of well-known methods including hot melt lamination and extrusion lamination.

Any desired method may be used in applying the laminate film to the core. For example, after the core is enclosed with the cover innermost layer to form a ball having a smooth (or dimple-free) spherical surface, the ball is wrapped with the laminate film and they are tightly joined together by means of a vacuum packaging equipment. The ball is transferred to a dimple embossing mold where heat compression molding is carried out at a temperature of 90° to 150° C. and a pressure of 500 to 20,000 N/cm$^2$ for about 2 to 10 minutes, embossing dimples in the ball surface.

It is acceptable to form a paint coating on the cover outermost layer. However, since the cover outermost layer also serves as a top coat, an extra coating is not necessarily needed in the invention. Once the cover outermost layer is formed, the ball requires only buffing or finishing to remove burrs before delivery as a commercial product. The invention can eliminate a paint coating step while the cover outermost layer has a uniform gage.

The present invention is applicable to either wound golf balls or solid golf balls.

In the case of wound golf balls, the center may be any of centers commonly used in conventional wound golf balls. It may be either a liquid center or a solid center, both of any well-known composition.

Where the liquid center is used, the preferred fill liquid is water. Since a specific gravity in the range of 1.0 to 2.3, especially 1.0 to 1.7 is preferred, finely divided powder, surfactant and the like may be added to water to provide such a specific gravity. The finely divided powder is of a material which is insoluble in water and can be finely divided, for example, fillers such as barium sulfate, zinc oxide and silica. The surfactant used herein includes dodecylbenzenesulfonic acid and sodium dodecylbenzenesulfonate. The rubber bag or center bag which is filled with the liquid may be of any well-known composition.

Where the solid center is used, no particular limit is imposed on the polymer composition of which the center is formed. Useful are polybutadiene rubber crosslinked and cured with an unsaturated carboxylic acid or metal salt thereof and polybutadiene rubber crosslinked and cured with both an unsaturated carboxylic acid or metal salt thereof and an unsaturated carboxylate. In the polybutadiene rubber, there may be blended other components such as zinc oxide, organic peroxides, and fillers in appropriate amounts.

Thread rubber is wound on the center to form a wound core. The center preferably has a diameter of 24 to 32 mm, especially 27 to 31 mm and a weight of 10 to 26 grams, especially 16 to 23 grams. The type of thread rubber and the method of winding thread rubber may be in accord with well-known techniques. The wound core preferably has a diameter of 34 to 39 mm, especially 35 to 37 mm and a hardness as expressed by a distortion of 2.8 to 6.0 mm, especially 3.6 to 4.8 mm under a load of 100 kg.

In the case of solid golf balls, the invention is advantageously applicable to multi-piece solid golf balls having a solid core enclosed with a cover of a three or more layer structure. Though not critical, the solid core preferably has a weight of 22 to 32 grams, especially 25 to 29 grams, a diameter of 33 to 38 mm, especially 34 to 36 mm and a hardness as expressed by a distortion of 2.8 to 6.0 mm, especially 3.5 to 4.5 mm under a load of 100 kg.

No particular limit is imposed on the stock material and preparation of the solid core. The solid core is generally formed of a composition comprising a base rubber, a crosslinking agent, a co-crosslinking agent, and an inert filler. The base rubber used herein may be natural rubber and/or synthetic rubber conventionally used in solid golf balls although 1,4-polybutadiene having at least 40% of cis-structure is especially preferred in the invention. The polybutadiene may be blended with a suitable amount of natural rubber, polyisoprene rubber, styrene-butadiene rubber or the like if desired. The crosslinking agent includes organic peroxides such as dicumyl peroxide and dit-butyl peroxide, with dicumyl peroxide being preferred. It is noted that the amount of the crosslinking agent blended is suitably determined although it is usually about 0.5 to 2 parts by weight per 100 parts by weight of the base rubber. The co-crosslinking agent used herein is not critical. Examples include metal salts of unsaturated fatty acids, inter alia, zinc and magnesium salts of unsaturated fatty acids having 3 to 8 carbon atoms (e.g., acrylic acid and methacrylic acid), with zinc acrylate being especially preferred. Examples of the inert filler include zinc oxide, barium sulfate, silica, calcium carbonate, and zinc carbonate, with zinc oxide and barium sulfate being often used. The amount of the filler blended is usually about 10 to 30 parts by weight per 100 parts by weight of the base rubber although the amount largely varies with the specific gravity of the core and cover, the standard weight of the ball, and other factors and is not critical. In the practice of the invention, the hardness of the core can be adjusted optimum by properly adjusting the amount of the filler (typically zinc oxide and barium sulfate) blended.

A core-forming composition is prepared by kneading the above-mentioned components in a conventional mixer such as a Banbury mixer and roll mill, and it is compression or injection molded in a core mold. The molding is then cured by heating at a sufficient temperature for the crosslinking agent and co-crosslinking agent to function (for example, a temperature of about 130° to 170° C. for a combination of dicumyl peroxide as the crosslinking agent and zinc acrylate as the co-crosslinking agent), obtaining a solid core.

With the above-mentioned construction, the golf ball of the invention is improved in spin properties. More specifically, provided that the ball gains a spin rate A when struck with a driver at a head speed of 45 m/sec. and a spin rate B when struck with a sand wedge at a head speed of 19 m/sec., the ratio B/A is at least 2.5/1, more preferably between 2.55/1 and 2.65/1. Then the ball is easy to control on approach shots. Although the hardness of the golf ball of the invention is not particularly limited, the ball preferably has a distortion of 2.5 to 3.8 mm, especially 2.7 to 3.1 mm under a load of 100 kg.

While the golf ball of the invention is constructed as mentioned above, its diameter, weight and initial velocity should meet the Rules of Golf. The ball has a diameter of not less than 42.67 mm and a weight of not greater than 45.93 grams, and an initial velocity of not greater than 250 ft./sec. (76.2 m/sec.) with a maximum tolerance of 2%.

There has been described a golf ball which has a soft feel, is improved in initial velocity, carry, and spin, and is thus easy to control on approach shots with a sand wedge or putter.

EXAMPLE

Examples of the present invention are given below by way of illustration and not by way of limitation.

Examples 1–4 & Comparative Examples 1–3

A solid core was conventionally prepared from the following rubber composition.

| Rubber composition | Parts by weight |
|---|---|
| Cis-1,4polybutadiene rubber | 100 |
| Zinc acrylate | 24 |
| Zinc oxide | 19 |
| Antioxidant | 1 |
| Dicumyl peroxide | 1 |

The core 1 was prepared by milling the components in a roll mill and compression molding the compound in a mold at 155° C. for about 15 minutes. A cover was formed around the core. The resins used to form the innermost, intermediate and outermost layers 3,4,5 are shown in Table 1. The cover innermost and intermediate layers were injection molded. The cover outermost layer 5 was formed by compression molding a film cover in a mold in Examples 1 to 4 and Comparative Example 2. The thus obtained golf balls had a diameter of 42.7 mm.

The golf balls were examined for flight performance, spin, and feeling by the following tests.

Flight performance and spin

Using a swing robot manufactured by Miyamae K.K., the ball was hit with a driver (#W1) at a head speed of 45 m/s (HS45) and with a sand wedge (SW) at a head speed of 19 m/sec. (HS19) to measure an initial velocity (IV, m/sec.) and spin rate (rpm). For the measurement of spin rate, Science Eye (manufactured by Bridgestone Sports Co.) was used.

(1) W#1 club

Head: JS-METAL (Bridgestone Sports Co.) loft angle 9.5°, lie angle 57° SUS 630 stainless steel, lost wax process Shaft: Harmotec Pro HM-70 LK hardness X (2) W#1 hitting method The club is set on the robot and swung to hit the ball which is placed 10 cm forward of the position the head takes when the shaft extends vertically as shown in FIG. 1.

(3) SW club

Figure 2:
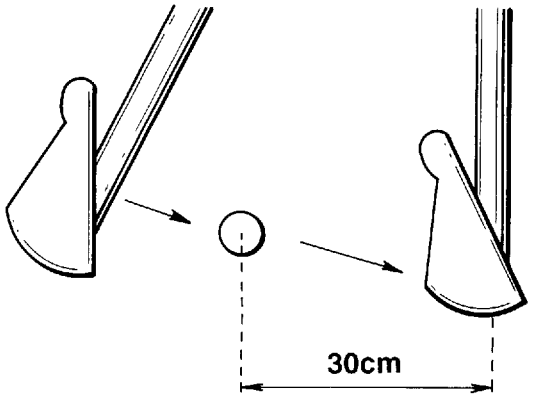
FIG. 2 illustrates how to hit a golf ball with a sand wedge in a hitting test.
Figure 3:
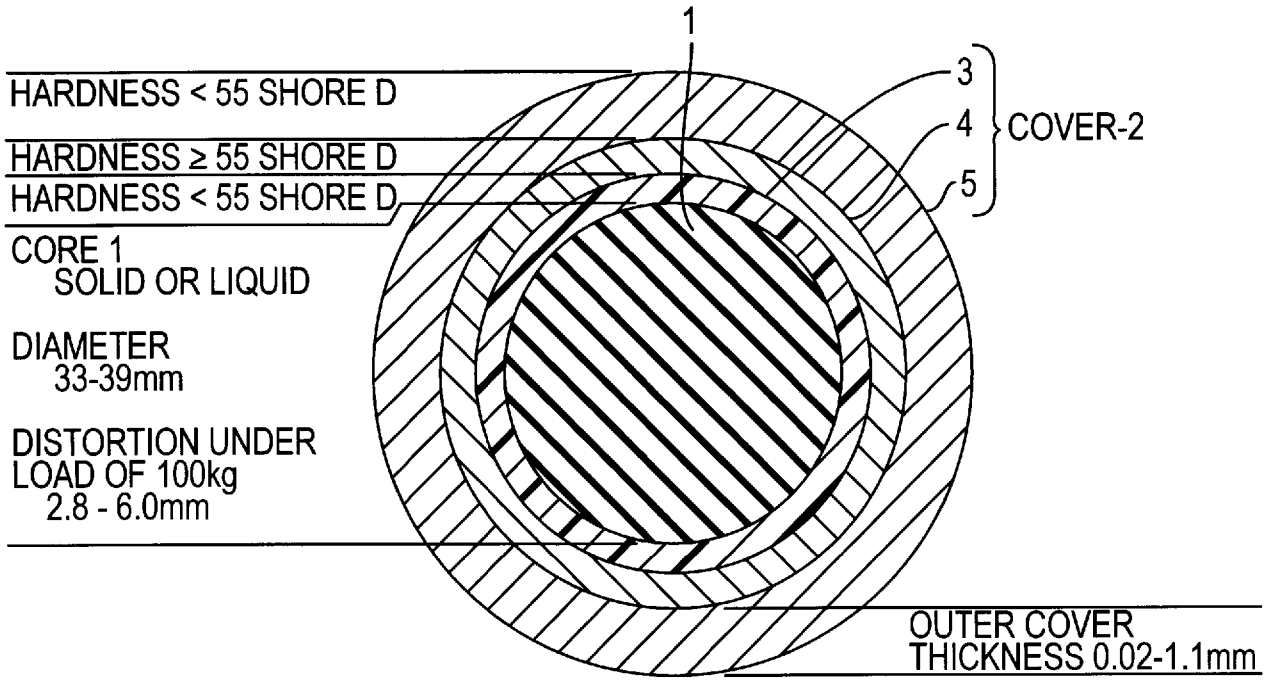
FIG. 3 is a cross section of the golf ball of this invention.

Head: JS-IRON Classical Edition (Bridgestone Sports Co.), loft angle 57°, lie angle 62° S25C mild steel, forging process Shaft: Harmotec Pro HM-70 MK hardness X (4) SW hitting method The club is set on the robot and swung to hit the ball which is placed 30 cm backward of the position the head takes when the shaft extends vertically as shown in FIG. 2.

Feel

Three professional golfers (designated G1, G2 and G3 in Table 2) with a head speed of 45 m/sec. (HS45) actually hit the balls to examine the feel. The ball was rated according to the following criterion.

⊚: very soft

○: soft

Δ: rather hard

TABLE 1

| | | Cover* | | | | Core |
|---|---|---|---|---|---|---|
| | | 4th layer | 3rd layer | 2nd layer | Outermost layer | diameter (mm) |
| Example 1 | Material | | Ionomer | Ionomer | Ionomer | 34.5 |
| | Gage (mm) | | 1.7 | 2.1 | 0.3 | |

TABLE 1-continued

| | | Cover* | | | | Core |
|---|---|---|---|---|---|---|
| | | 4th layer | 3rd layer | 2nd layer | Outermost layer | diameter (mm) |
| | Hardness (Shore D) | | 51 | 64 | 34 | |
| Example 2 | Material | | Polyester | Ionomer | Ionomer | 34.5 |
| | Gage (mm) | | 1.7 | 2.1 | 0.3 | |
| | Hardness (Shore D) | | 40 | 64 | 34 | |
| Example 3 | Material | | Polyester | Ionomer | Ionomer | 34.5 |
| | Gage (mm) | | 1.7 | 2.1 | 0.3 | |
| | Hardness (Shore D) | | 40 | 64 | 45 | |
| Example 4 | Material | Polyester | Ionomer | Ionomer | EVA | 34.5 |
| | Gage (mm) | 1.7 | 2.1 | 0.3 | 0.1 | |
| | Hardness (Shore D) | 40 | 64 | 34 | 45 | |
| Comparative | Material | | | | Ionomer | 38.5 |
| Example 1 | Gage (mm) | | | | 2.1 | |
| | Hardness (Shore D) | | | | 64 | |
| Comparative | Material | | | Ionomer | Ionomer | 37.9 |
| Example 2 | Gage (mm) | | | 2.1 | 0.3 | |
| | Hardness (Shore D) | | | 64 | 34 | |
| Comparative | Material | | | Polyester | Ionomer | 35.1 |
| Example 3 | Gage (mm) | | | 1.7 | 2.1 | |
| | Hardness (Shore D) | | | 40 | 64 | |

*4th, 3rd and 2nd layers are the fourth, third and second layers when counted from the outermost layer.

TABLE 2

| | Hitting rating | | | | | | | |
|---|---|---|---|---|---|---|---|---|
| | W#1 HS45 | | SW HS19 | | | Hitting feel | | |
| | IV (m/s) | Spin A (rpm) | IV (m/s) | Spin B (rpm) | B/A | G1 | G2 | G3 |
| Example 1 | 65.3 | 2856 | 19.3 | 7528 | 2.64 | Δ | ○ | ○ |
| Example 2 | 65.2 | 2840 | 19.3 | 7466 | 2.63 | ○ | ○ | ◎ |
| Example 3 | 65.4 | 2803 | 19.4 | 7290 | 2.60 | ○ | ○ | ○ |
| Example 4 | 65.3 | 2815 | 19.3 | 7269 | 2.58 | ○ | ○ | ◎ |
| Comparative Example 1 | 65.6 | 2899 | 19.5 | 6645 | 2.29 | Δ | Δ | Δ |
| Comparative Example 2 | 65.5 | 2943 | 19.3 | 7354 | 2.50 | ○ | Δ | Δ |
| Comparative Example 3 | 65.3 | 2777 | 19.6 | 6514 | 2.35 | ○ | ○ | ○ |

As is evident from Tables 1 and 2, the ball of Comparative Example 1 is a 2-piece solid golf ball having a single layer cover and provides a low spin rate and hard feel due to the hard cover. The balls of Comparative Examples 2 and 3 are 3-piece solid golf balls having a two-layer cover. In Comparative Example 2, the cover outermost layer is soft and the cover innermost layer is hard. In Comparative Example 3, the cover outermost layer is hard and the cover innermost layer is soft. The ball of Comparative Example 3 provides a low spin rate because of the hard outermost layer.

In contrast, the golf balls of Examples 1 to 4 within the scope of the invention have a cover of three or more layers wherein the outermost and innermost layers are softer than the intermediate layer (the inside one of the intermediate layers in Example 4). These golf balls are increased in initial velocity and spin rate, especially an increased spin rate upon sand wedge shots, and are thus easy to control upon approach shots.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball comprising; a core and a multi-layered cover having an innermost layer enclosing the core, at least one intermediate layer enclosing the innermost layer, and an outermost layer enclosing the at least one intermediate layer, said innermost layer being composed of an ionomer resin, polyester elastomer, polyamide elastomer or polyurethane elastomer, said at least one intermediate layer being composed of an ionomer resin, said outermost layer being composed of an ionomer resin, ethylene-vinyl acetate copolymer, polyurethane or polyethylene or a mixture thereof, and the at least one intermediate layer comprising at least one layer which is harder than the innermost layer and the outermost layer.

2. The golf ball of claim 1 wherein said cover has a plurality of intermediate layers, among which the layer which is harder than the innermost layer and the outermost layer is an inside layer closely enclosing the innermost layer.

3. The golf ball of claim 2 wherein the cover outermost layer has a Shore D hardness of less than 55 degrees, the cover innermost layer has a Shore D hardness of less than 55 degrees, and the inside layer of the intermediate layers has a Shore D hardness of not less than 55 degrees.

4. The golf ball of claim 1 wherein a spin rate A when struck with a driver having a loft angle of 9.5° and a lie angle of 57° at a head speed of 45 m/sec. and a spin rate B when struck with a sand wedge having a loft angle of 57° and a lie angle of 62° at a head speed of 19 m/sec. are achieved when said clubs are mounted on a swing robot and the club is extended 30 cm backward from a vertical position to strike said ball, and wherein the ratio B/A is at least 2.5/1.

5. The golf ball of claim 1 wherein said cover innermost layer has a Shore D hardness in the range of 40 to 51 degrees.

6. The golf ball of claim 1 wherein said at least one intermediate layer has a Shore D hardness in the range of 61 to 66 degrees.

7. The golf ball of claim 1 wherein said cover outermost layer has a Shore D hardness in the range of 34 to 52 degrees.

8. The golf ball of claim 1 wherein said cover innermost layer has a radial thickness in the range of 1.0 to 2.0 mm.

9. The golf ball of claim 1 wherein said at least one intermediate layer consists of a single layer, said single layer having a radial thickness in the range of 1.7 to 2.5 mm.

10. The golf ball of claim 1 wherein said at least one intermediate layer comprises two layers and wherein an inner layer of said two intermediate layers has a radial thickness of at least 1.7 mm.

11. The golf ball of claim 1 wherein said at least one intermediate layer comprises at least two layers and an innermost layer has a Shore D hardness in the range of 61 to 66 degrees.

12. The golf ball of claim 11 wherein another layer of said at least two layers has a Shore D hardness in the range of 30 to 54 degrees.

13. The golf ball of claim 5 wherein said cover outermost layer has a radial thickness in the range of 0.02 to 1.1 mm.

14. The golf ball of claim 1 wherein said core comprises a liquid center.

15. The golf ball of claim 14 wherein said liquid center has a specific gravity in the range of 1.0 to 2.3.

16. The golf ball of claim 1 wherein said core is solid.

17. The golf ball of claim 16 wherein said solid core comprises a thread rubber wound layer.

18. The golf ball of claim 16 wherein said wound core has a diameter in the range of 34 to 39 mm.

19. The golf ball of claim 16 wherein said solid core has a distortion of 2.8 to 6.0 mm under a load of 100 kg.

20. The golf ball of claim 16 wherein said solid core has a diameter in the range of 33 to 38 mm.

* * * * *